US007862378B1

(12) United States Patent
Wan et al.

(10) Patent No.: US 7,862,378 B1
(45) Date of Patent: Jan. 4, 2011

(54) VERTICAL SOCKET CONNECTOR

(75) Inventors: Wei Wan, Hsin-Tien (TW); Shu-Lin Duan, Hsin-Tien (TW); Ching-Tien Chen, Hsin-Tien (TW); Pin-Yuan Hou, Hsin-Tien (TW); Wen-Chih Ko, Hsin-Tien (TW)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 0 days.

(21) Appl. No.: 12/588,195

(22) Filed: Oct. 7, 2009

(30) Foreign Application Priority Data

Aug. 24, 2009 (TW) ..... 98215586 U

(51) Int. Cl.
*H01R 13/648* (2006.01)

(52) U.S. Cl. ..... 439/607.35; 439/607.54; 439/660

(58) Field of Classification Search ..... 439/607.35, 439/607.54, 607.55, 660
See application file for complete search history.

(56) References Cited

U.S. PATENT DOCUMENTS

| | | | | |
|---|---|---|---|---|
| 7,364,463 | B1 * | 4/2008 | Ju | 439/607.55 |
| 7,648,390 | B2 * | 1/2010 | Zhang et al. | 439/541.5 |
| 7,762,840 | B2 * | 7/2010 | Hamner et al. | 439/541.5 |
| 2009/0305555 | A1 * | 12/2009 | Wang et al. | 439/541.5 |

* cited by examiner

*Primary Examiner*—Hien Vu
(74) *Attorney, Agent, or Firm*—Bacon & Thomas, PLLC

(57) ABSTRACT

A vertical socket connector has an insulating housing, an insulating bracket, multiple first terminals, multiple second terminals and a shell. The insulating bracket is mounted on the insulating housing. The first terminals are mounted on the insulating housing. The second terminals are mounted on the insulating bracket. The shell covers the insulating housing, insulating bracket and terminals and forms a socket hole. Soldering sections of the first and second terminals protrude horizontally backward through rears of the insulating housing and insulating bracket so that the vertical socket connector is mounted vertically on a PCB with the socket hole opposite to the PCB.

8 Claims, 9 Drawing Sheets

VERTICAL SOCKET CONNECTOR

BACKGROUND OF THE INVENTION

1. Field of the Invention

The present invention relates to a connector, and more particularly to a vertical socket connector that supports two transmission protocols and has multiple terminals with soldering sections horizontally extending out of a rear end of the vertical socket connector so that the rear end of the vertical socket connector is mounted on a printed circuit board (PCB).

2. Description of Related Art

Conventional Universal Serial Bus (USB) 2.0 connectors are popularly used in various electronic devices. However, the USB 2.0 protocol only allows a maximum transmission speed of 480 Mbps. Because electronic devices are constantly developed to increase transmission speed thereof, the USB 2.0 protocol does not meet the current transmission speed requirement of new electronic devices. Therefore, the USB Implementers Forum sets up a USB 3.0 protocol that may achieve a theoretical maximum transmission speed of 5 Gbps.

However, a USB 3.0 connector having two rows of terminals is structurally complicated so that manufacturing a qualifying USB 3.0 connector is difficult. The total length of the USB 3.0 connector is elongated due to the rows of terminals and therefore broadens the USB 3.0 connector. Furthermore, the terminals of the USB 3.0 connector generate crosstalk to interfere with each other when transmitting high frequency signals. Therefore, the USB 3.0 connector has a low production rate and a high manufacturing cost.

Furthermore, terminals of a standard USB 3.0 socket connector have soldering sections perpendicularly bent and extending down through a bottom of the socket USB3.0 socket connector so that the bottom of the USB 3.0 socket connector is mounted on a PCB. However, some electronic devices that are configured specifically need socket connectors vertically mounted on a PCB so that socket holes of the socket connectors face upward relative to the PCB. Conventional USB 3.0 connectors do not have a vertically mounted configuration.

To overcome the shortcomings, the present invention provides a vertical socket connector to mitigate or obviate the aforementioned problems.

SUMMARY OF THE INVENTION

The main objective of the invention is to provide a vertical socket connector that supports two transmission protocols and has multiple terminals with soldering sections horizontally extending out of a rear end of the vertical socket connector so that the rear end of the vertical socket.

A vertical socket connector in accordance with the present invention has an insulating housing, an insulating bracket, multiple first terminals, multiple second terminals and a shell. The insulating bracket is mounted on the insulating housing. The first terminals are mounted on the insulating housing. The second terminals are mounted on the insulating bracket. The shell covers the insulating housing, insulating bracket and terminals and forms a socket hole. Soldering sections of the first and second terminals protrude horizontally backward through rears of the insulating housing and insulating bracket so that the vertical socket connector is mounted vertically on a PCB with the socket hole opposite to the PCB.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
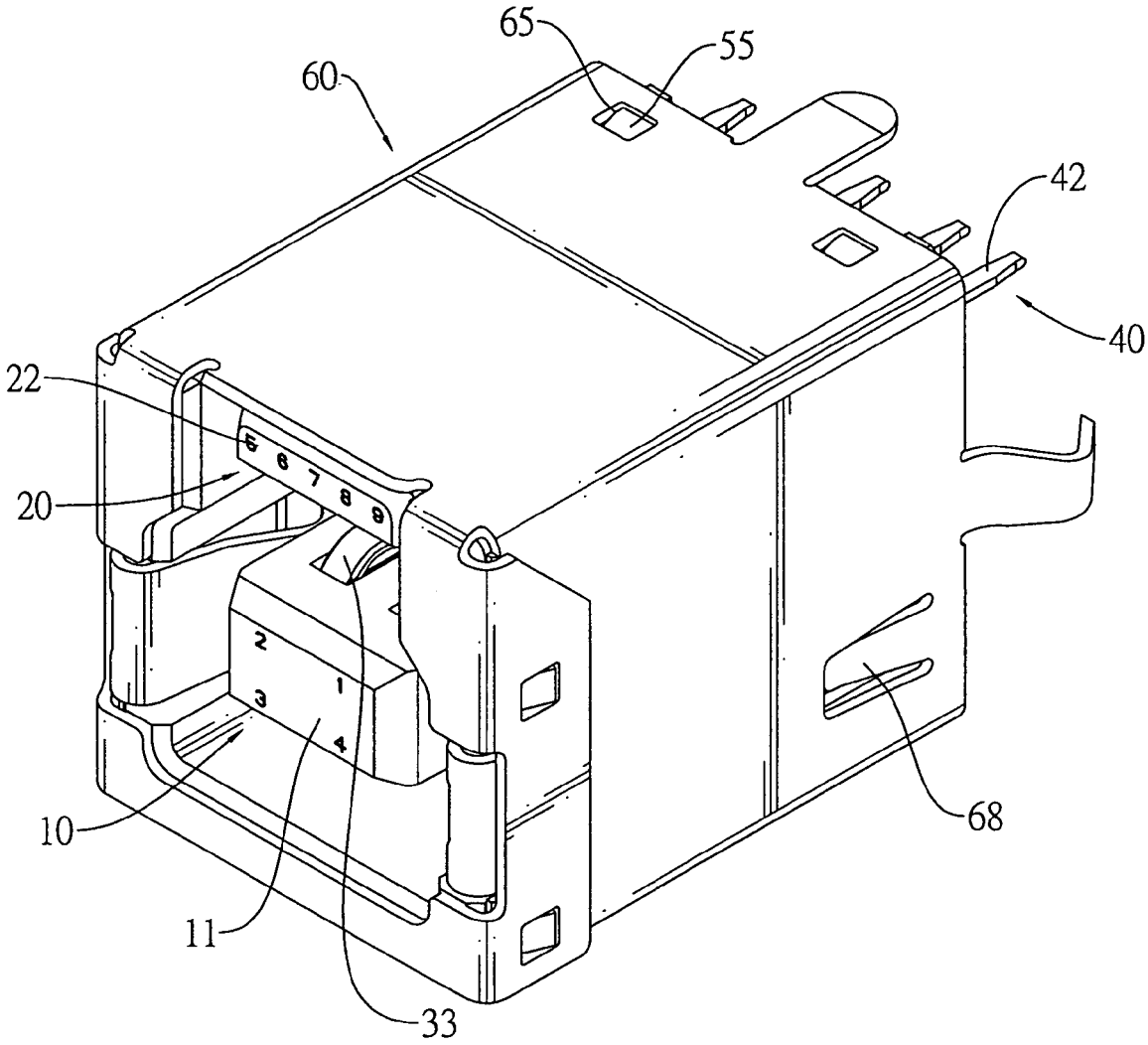
FIG. 1 is a front perspective view of a vertical socket connector in accordance with the present invention.
Figure 2:
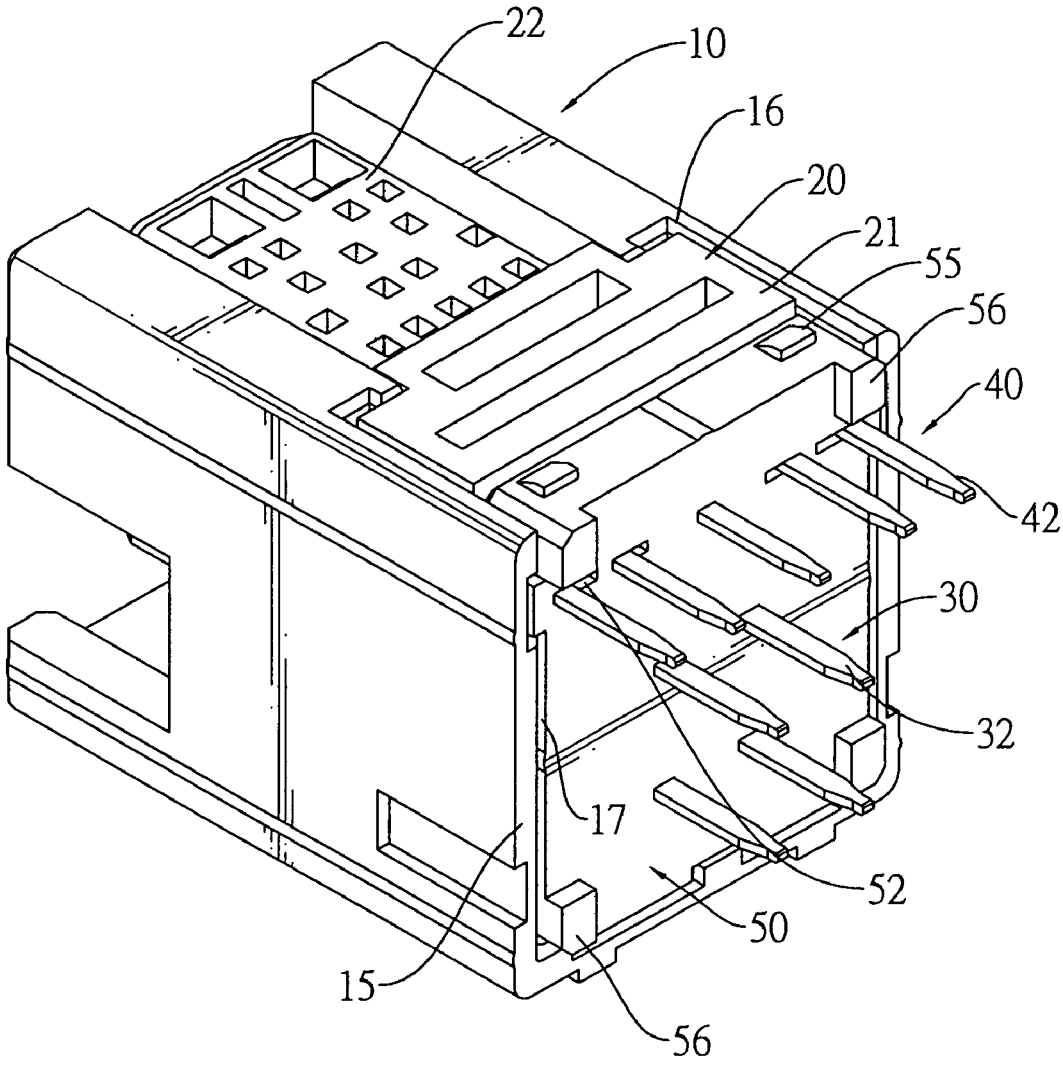
FIG. 2 is a rear perspective view of the vertical socket connector in FIG. 1 omitting a shell.
Figure 3:
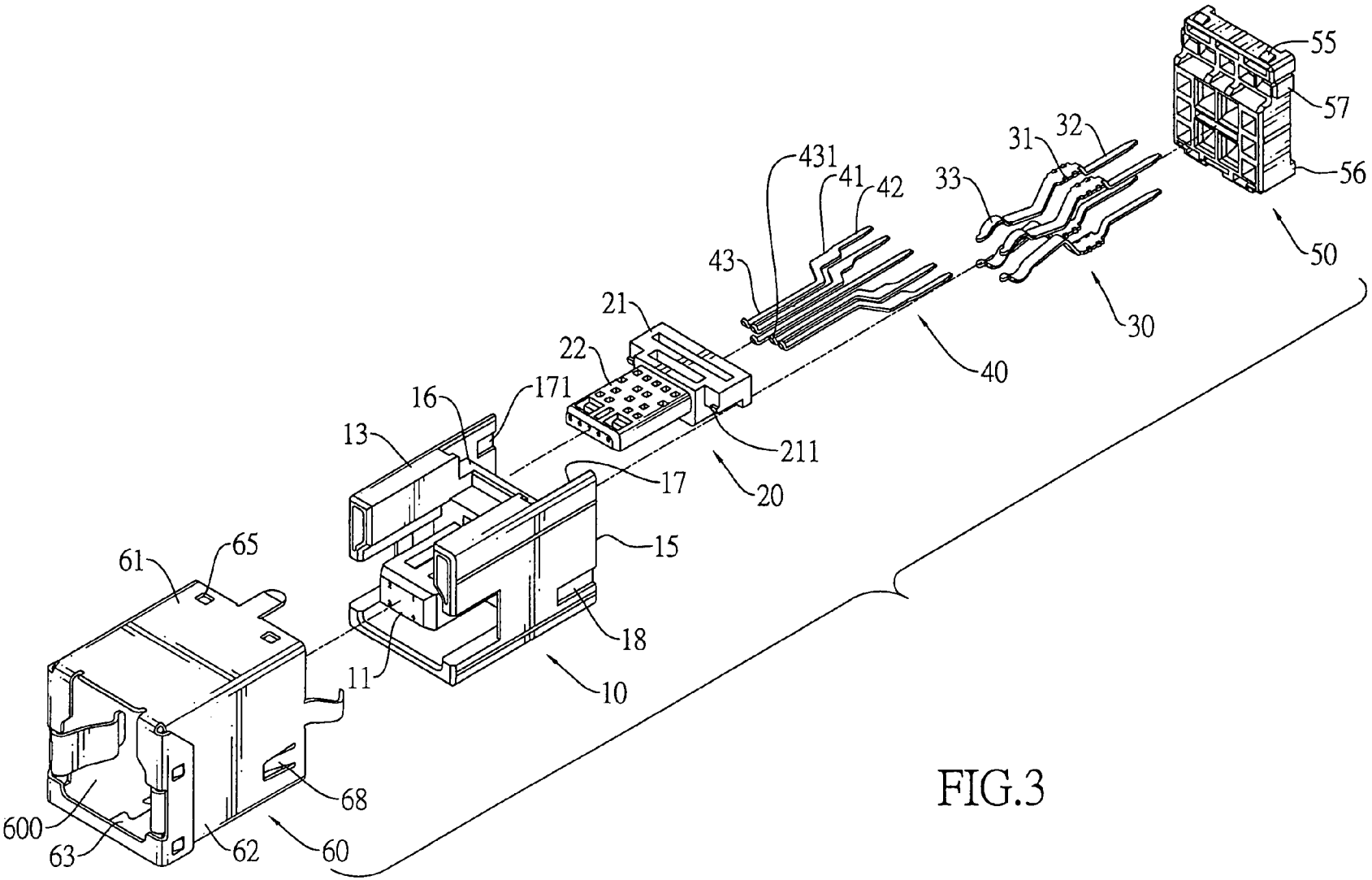
FIG. 3 is an exploded front perspective view of the vertical socket connector in FIG. 1.
Figure 4:
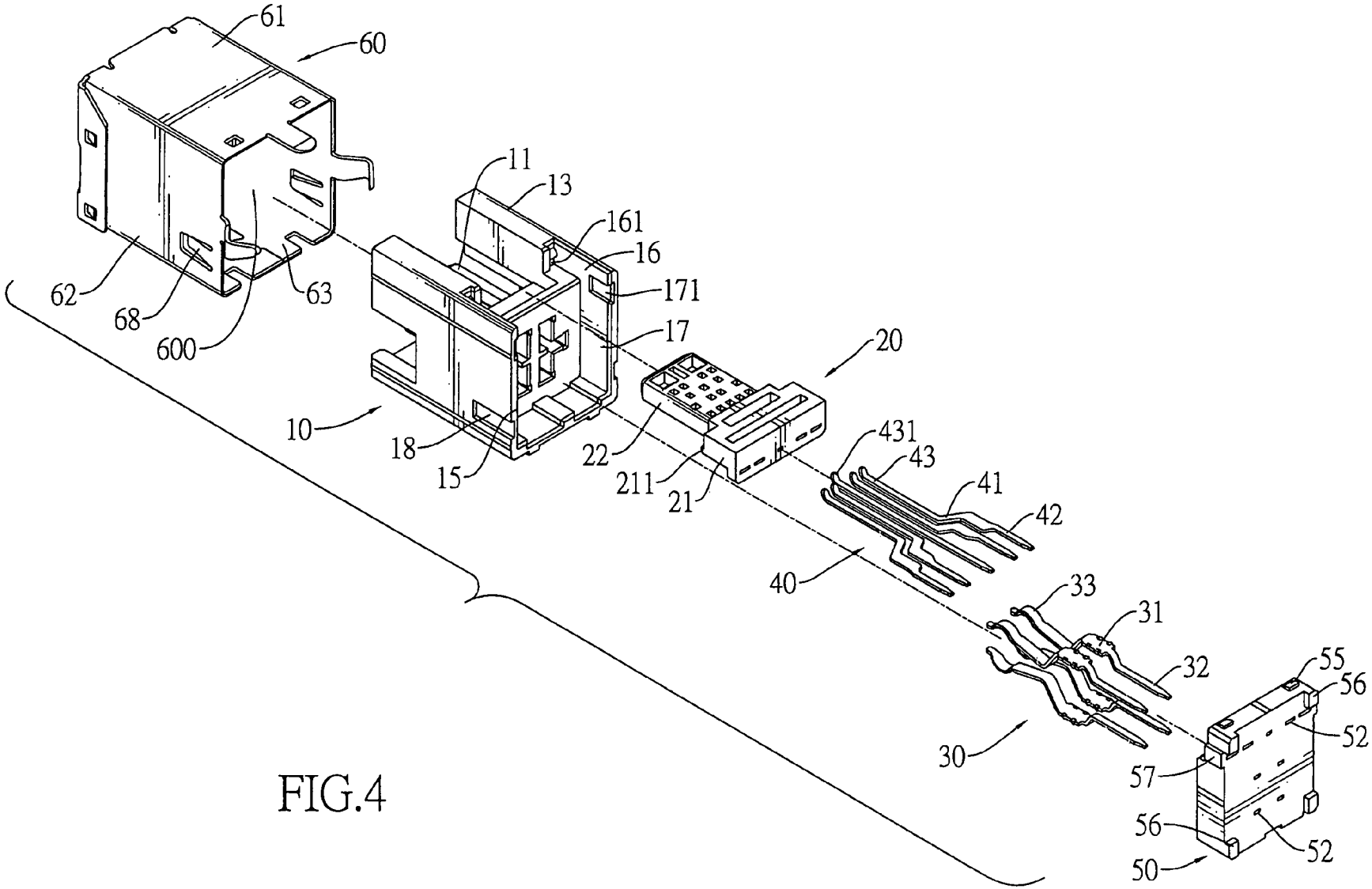
FIG. 4 is an exploded rear perspective view of the vertical socket connector in FIG. 1.
Figure 5:
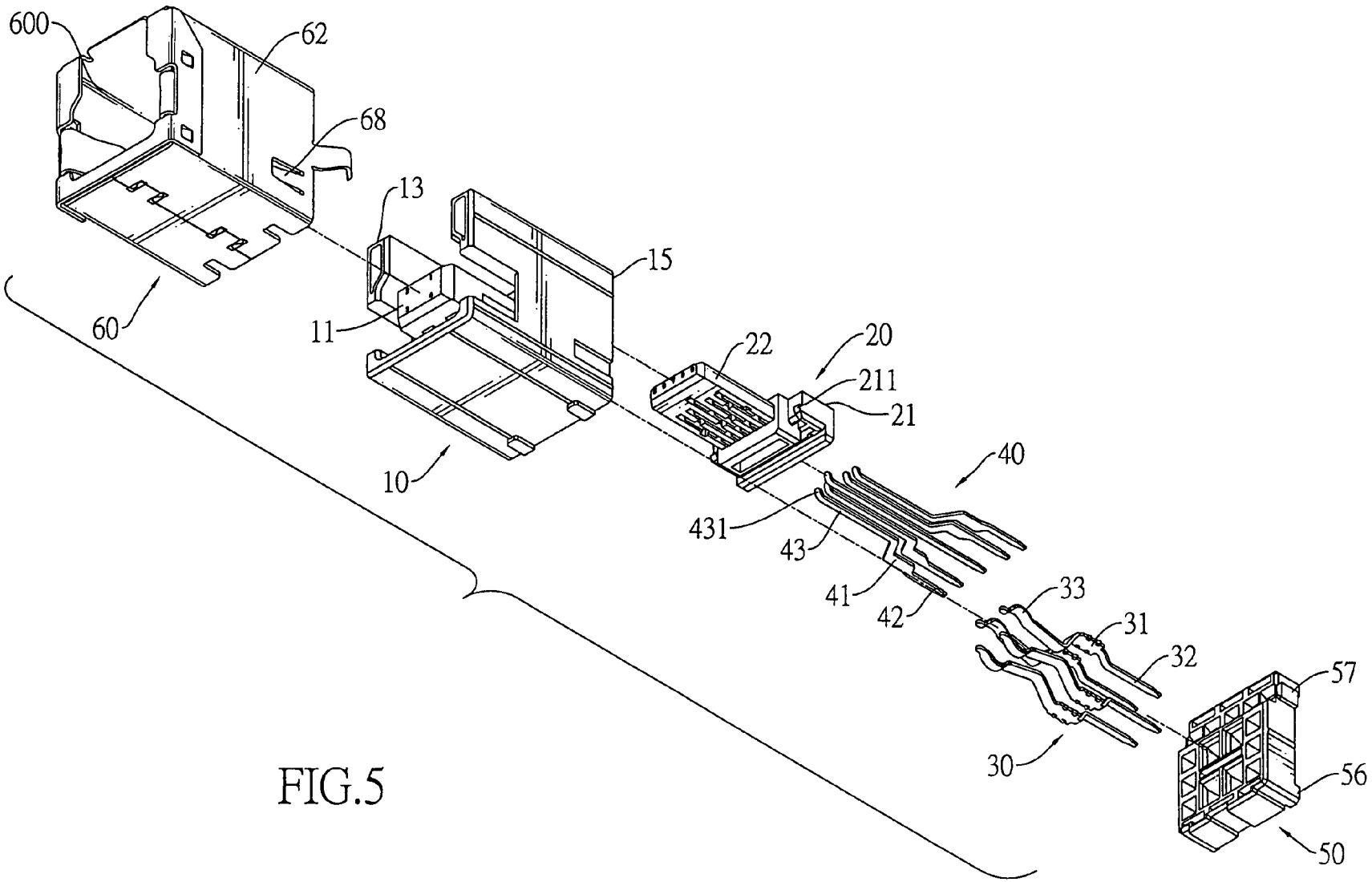
FIG. 5 is an exploded bottom perspective view of the vertical socket connector in FIG. 1.
Figure 6:
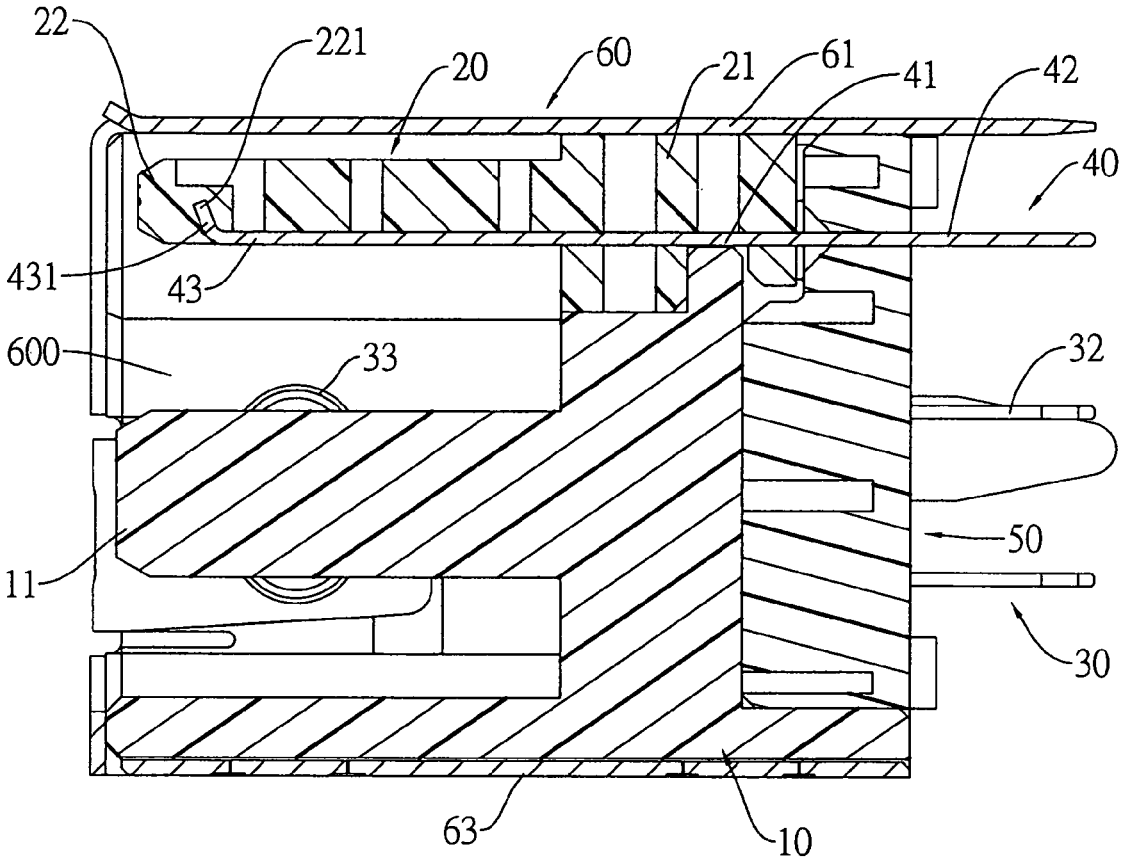
FIG. 6 is a cross sectional side view of the vertical socket connector in FIG. 1.
Figure 7:
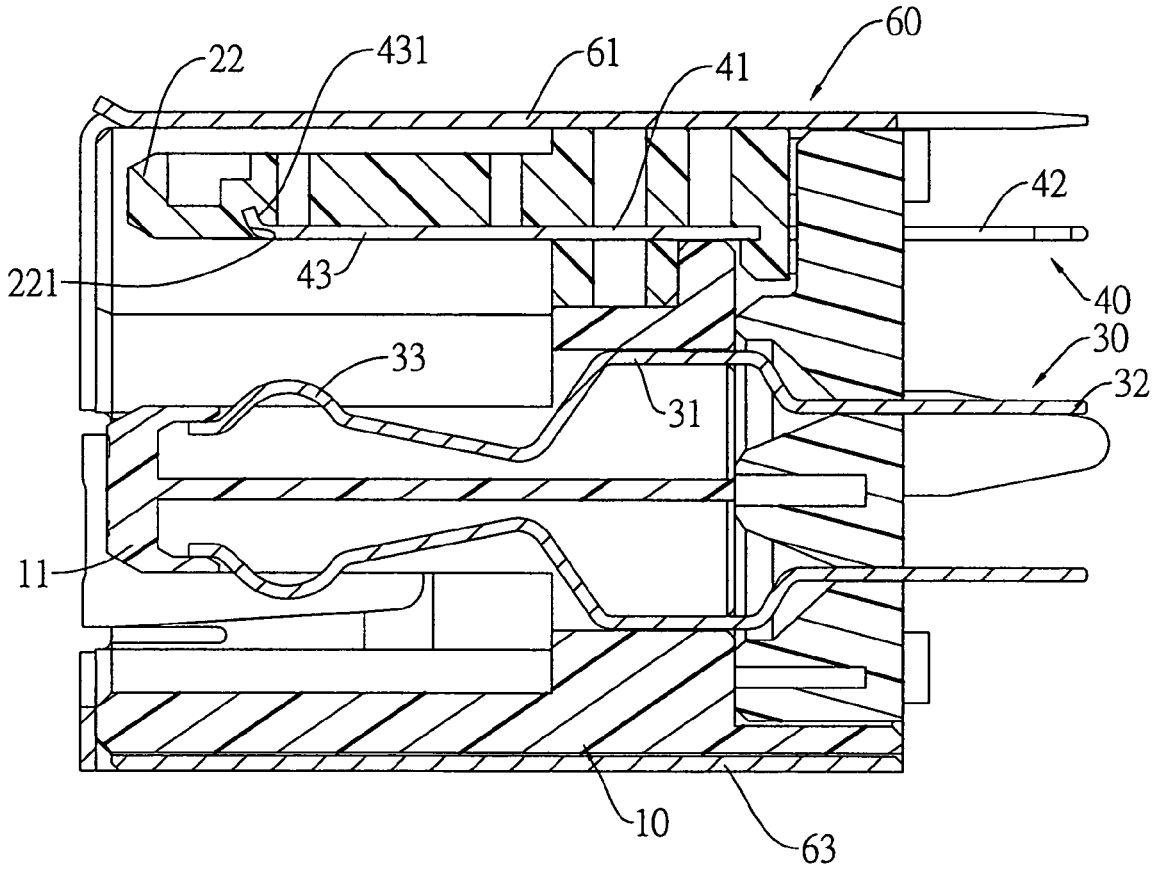
FIG. 7 is another cross sectional side view of the vertical socket connector in FIG. 1.
Figure 8:
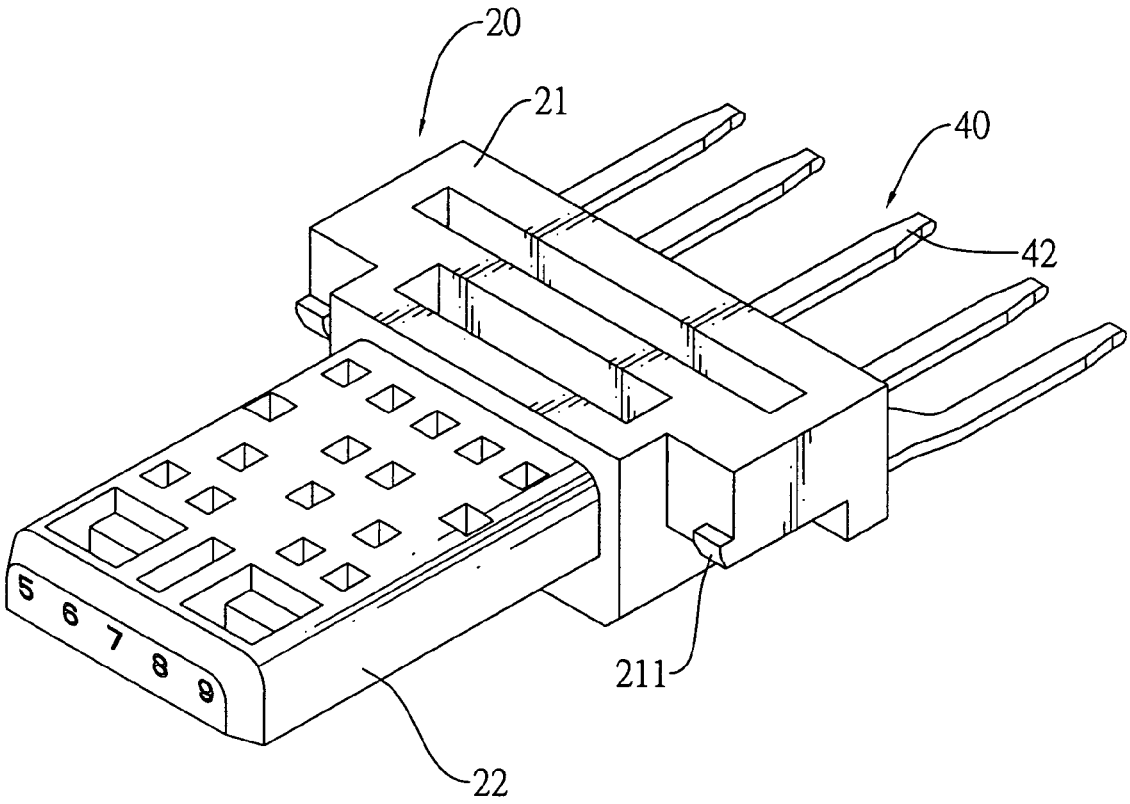
FIG. 8 is a top perspective view of insulating bracket and second terminals of the vertical socket connector in FIG. 1.
Figure 9:
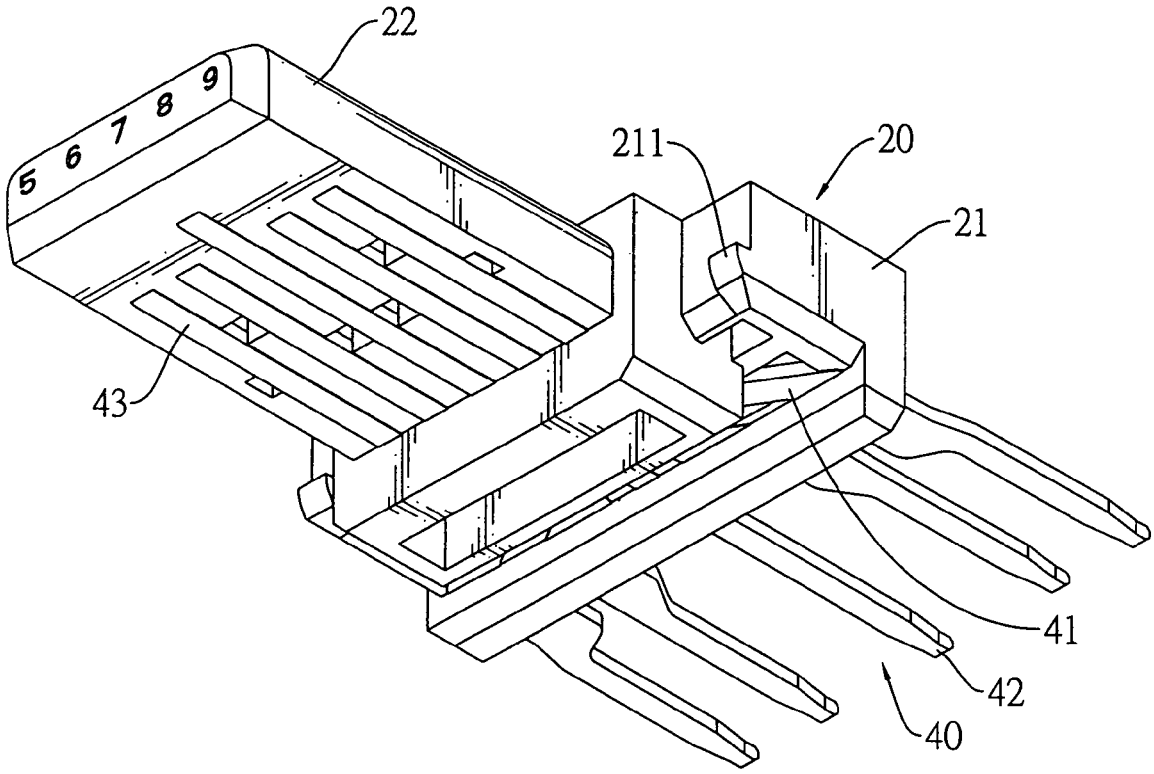
FIG. 9 is a bottom perspective view of the insulating bracket and second terminals of the vertical socket connector in FIG. 1.

With reference to FIGS. 1 to 5, a vertical socket connector in accordance with the present invention may be mounted on a PCB and comprises an insulating housing (10), an insulating bracket (20), multiple first terminals (30), multiple second terminals (40), a positioning bracket (50) and a shell (60).

The insulating housing (10) has a top (13), a bottom, a front, a rear, two opposite sides, a first tongue (11) and a mounting slot (16) and may further have a fastening slot (17) and two locking slots (18).

The first tongue (11) is formed on and protrudes from the insulating housing (10) and has a top surface and a bottom surface.

The mounting slot (16) is defined in the top and may have two opposite inner surfaces and two positioning notches (161). The inner surfaces correspond to the sides of the insulating housing (10). The positioning notches (161) are defined respectively in the inner surfaces.

The fastening slot (17) is defined in the rear and has two opposite inside surfaces and two mounting notches (171). The inside surfaces correspond to the sides. The mounting notches (171) are defined respectively in the inside surfaces.

The locking slots (18) are defined respectively in the sides adjacent to the rear of the insulating housing (10).

The insulating bracket (20) is mounted in the insulating housing (10) and has a base (21) and a second tongue (22).

The base (21) is mounted in the mounting slot (16) of the insulating housing (10), has a front end and a rear end and may further have two positioning protrusions (211). The positioning protrusions (211) are formed on and protrude forward from the front end of the base (21) and are mounted respectively in the positioning notches (161).

The second tongue (22) is formed on and protrudes forward from the front end of the base (21), is located above the first tongue (21) and has a top surface and a bottom surface and multiple embedding slots (221). The embedding slots (221) are defined obliquely in the bottom surface of the second tongue (22).

The first terminals (30) are mounted through the first tongue (11) of the insulating housing (10). In a preferred embodiment of the vertical socket connector, the first terminals (30) are four and are capable of implementing USB 2.0 signal transmission. Two first terminals (30) are mounted on the top surface of the first tongue (13) and the other two second terminals (30) are mounted on the bottom surface.

Each first terminal (30) has a mounting section (31), a soldering section (32) and a contacting section (33).

The mounting section (31) is mounted in the insulating housing (10).

The soldering section (32) is formed on the mounting section (31), protrudes horizontally backward out of the rear of the insulating housing (10) and parallels the top (13) and the bottom of the insulating housing (10).

The contacting section (33) is formed on and protrudes forward from the mounting section (31).

The second terminals (40) are horizontal relative to the insulating housing (10) and are mounted through the insulating bracket (20) by an insert-molding process. In a preferred embodiment of the vertical socket connector, the second terminals (40) are five, are mounted on the bottom surface of the second tongue (22) and are capable of cooperating with the first terminals (30) to implement USB 3.0 signal transmission.

Each second terminal (40) has a mounting section (41), a soldering section (42) and a contacting section (43).

The mounting section (41) is mounted in the base (21) of the insulating bracket (20).

The soldering section (42) is formed on the mounting section (41) and protrudes horizontally backward out of the rear end of the base (21).

The contacting section (43) is formed on and protrudes forward from the mounting section (41), is mounted on the bottom surface of the second tongue (22) and has a distal end and an embedding tab (431). The embedding tab (431) is formed on and protrudes obliquely from the distal end and is mounted securely in one embedding slot (221) of the second tongue (22) by the insert-molding process.

The positioning bracket (50) is mounted in the fastening slot (17) of the insulating housing (10), has a top, a bottom, a front, a rear, two opposite sides and multiple positioning holes (52) and may further have two mounting protrusions (57), at least one engaging protrusion (55) and multiple feet (56).

The positioning holes (52) are defined through the positioning bracket (50) from the front to the rear, parallel the top and bottom and are respectively mounted around and hold the soldering sections (32, 42) of the first and second terminals (30, 40).

The mounting protrusions (57) are formed respectively on and protrude transversely from the sides of the positioning bracket (50) and are mounted respectively in the mounting notches (171) of the insulating housing (10).

The at least one engaging protrusion (55) is formed on and protrudes upward from the top of the positioning bracket (50).

The feet (56) are formed on and protrude horizontally backward from the rear of the positioning bracket (50) and parallel the soldering sections (32, 42) of the first and second terminals (30, 40).

The shell (60) covers the insulating housing (10), insulating bracket (20), first terminals (30), second terminals (40) and positioning bracket (50), has a top plate (61), two opposite side plates (62), a bottom plate (63) and a cavity (600) and may further have two locking tabs (68) and at least one engaging hole (65).

The side plates (62) are formed on and protrude downward from the top plate (61).

The bottom plate (63) is formed between the side plates (62).

The cavity (600) is defined through the shell (60) and forms a socket hole to hold a corresponding plug connector.

The locking tabs (68) are formed respectively on the side plates (62) and are mounted respectively in the locking slots (18) of the insulating housing (10) to prevent the shell (60) from inadvertently slipping on the insulating housing (10).

The at least one engaging hole (65) is defined in the top plate (61) and respectively engages with the at least one engaging protrusion (55) to prevent the shell (60) from inadvertently disengaging from the insulating housing (10).

The vertical socket connector has the following advantages.

1. The insulating housing (10) and the insulating bracket (20) are separate components that use different molds when manufactured. Therefore, designing each mold is easy and increases the production rates of the insulating housing (10) and the insulating bracket (20).

2. The soldering sections (32, 42) of the first and second terminals (30, 40) horizontally extend out of the rear end of the insulating housing (10) so that the vertical socket connector is mounted vertically on the PCB with the socket hole opposite to the PCB. Such a vertically mounted configuration allows the vertical socket connector to be applied to specific electronic devices.

3. The embedding tabs (431) of the second terminals (40) embedded in the second tongue (22) prevent the second terminals (40) from deforming or disengaging from the second tongue (22) due to repetitive engagement and disengagement of the vertical socket connector and corresponding plug connector.

4. The insulating housing (10) and insulating bracket (20) are combined together through the positioning notches (161), fastening slot (171) and positioning protrusions (211) without further fasteners so that assembling the insulating housing (10) and the insulating bracket (20) is easy.

5. The feet of the positioning bracket (50) contact or extend through the PCB to assure that the vertical socket connector is vertically mounted on the PCB without being inclined.

6. The shell (60) is quickly mounted on the insulating housing (10) through the locking slots (18) and the locking tabs (68) without precisely alignment so that assembling the shell (60) is easy.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A vertical socket connector comprising:

an insulating housing having a top, a bottom, a front, a rear and two opposite sides and further having a first tongue formed and protruding from the insulating housing and having a top surface and a bottom surface; and a mounting slot defined in the top;

an insulating bracket mounted in the insulating housing and having a base mounted in the mounting slot of the insulating housing and having a front end and a rear end; and a second tongue formed on and protruding from the front end of the base, located above the first tongue and having a top surface, a bottom surface and multiple embedding slots defined in the bottom surface of the second tongue;

multiple first terminals mounted through the first tongue of the insulating housing and each first terminal having a mounting section mounted in the insulating housing;

a soldering section formed on the mounting section, protruding horizontally backward out of the rear of the insulating housing and paralleling the top and the bottom of the insulating housing; and a contacting section formed on and protruding forward from the mounting section;

multiple second terminals being horizontal relative to the insulating housing, mounted through the insulating bracket and each second terminal having a mounting section mounted in the base of the insulating bracket;

a soldering section formed on the mounting section and protruding horizontally backward out of the rear end of the base; and a contacting section formed on and protruding forward from the mounting section, mounted on the bottom surface of the second tongue and having a distal end; and an embedding tab formed on and protruding from the distal end and mounted securely in one embedding slot of the second tongue;

an insulating positioning bracket mounted in a fastening slot at the rear of the insulating housing and having a top, a bottom, a front, a rear and two opposite sides and further having multiple positioning holes defined through the positioning bracket from the front to the rear, paralleling the top and bottom and respectively mounted around and holding the soldering sections of the first and second terminals; and a conductive shell covering the insulating housing, insulating bracket, first terminals, second terminals and insulating positioning bracket;

wherein the mounting slot of the insulating housing has two opposite inner surfaces corresponding to the sides of the insulating housing; and two positioning notches defined respectively in the inner surfaces; and the base of the insulating bracket further has two positioning protrusions formed on and protruding forward from the front end of the base and mounted respectively in the positioning notches.

2. The vertical socket connector as claimed in claim 1, wherein the fastening slot of the insulating housing has two opposite inside surfaces corresponding to the sides of the insulating housing; and two mounting notches defined respectively in the inside surfaces; and the positioning bracket further has two mounting protrusions formed respectively on and protruding transversely from the sides of the positioning bracket and mounted respectively in the mounting notches of the insulating housing.

3. The vertical socket connector as claimed in claim 1, wherein the insulating housing further has two locking slots defined respectively in the sides adjacent to the rear of the insulating housing; and the shell further has a top plate, two side plates and a bottom plate and further has a cavity defined through the shell; and two locking tabs formed respectively on the side plates formed respectively on the side plates and mounted in the respectively in the locking slots of the insulating housing.

4. The vertical socket connector as claimed in claim 3, wherein the positioning bracket further has at least one engaging protrusion formed on and protruding upward from the top of the positioning bracket; and the shell further has at least one engaging hole defined in the top plate and respectively engaging with the at least one engaging protrusion of the positioning bracket.

5. The vertical socket connector as claimed in claim 4, wherein the first terminals are four, two of the first terminals are mounted on the top surface of the first tongue and the other two second terminals are mounted on the bottom surface; and the second terminals are five and are mounted on the bottom surface of the second tongue.

6. The vertical socket connector as claimed in claim 4, wherein the positioning bracket further has multiple feet formed on and protruding horizontally backward from the rear of the positioning bracket and paralleling the soldering sections of the first and second terminals.

7. The vertical socket connector as claimed in claim 4, wherein the first terminals are capable of implementing USB 2.0 signal transmission; and the second terminals are capable of cooperating with the first terminals to implement USB 3.0 signal transmission.

8. The vertical socket connector as claimed in claim 4, wherein the second terminals are mounted on the insulating bracket by an insert-molding process.

* * * * *